US005833196A

United States Patent [19]

Keith

[11] Patent Number: 5,833,196

[45] **Date of Patent: *Nov. 10, 1998**

[54] DESK TOP MAT

[76] Inventor: George A. Keith, 1191 Foxboro La., Bartlett, Ill. 60103

[ * ] Notice: The term of this patent shall not extend beyond the expiration date of Pat. No. 5,372,892.

[21] Appl. No.: 423,276

[22] Filed: Apr. 17, 1995

[51] Int. Cl.[6] ..... A47B 91/00

[52] U.S. Cl. ..... 248/345.1; 248/346.1

[58] Field of Search ..... 248/345.1, 346.01; 428/464, 455, 507, 537.1

[56] References Cited

U.S. PATENT DOCUMENTS

| | | | |
|---|---|---|---|
| 2,062,088 | 11/1936 | Dreyer | 428/455 |
| 2,560,420 | 7/1951 | Dodge | 428/455 |
| 2,828,219 | 3/1958 | Heiges et al. | 428/455 |
| 3,308,009 | 3/1967 | Baumgartner, Jr. | 428/455 X |
| 4,248,922 | 2/1981 | Shortway et al. | 428/159 |
| 5,073,431 | 12/1991 | Martinuzzo | 428/102 |
| 5,188,876 | 2/1993 | Hensel et al. | 428/76 |
| 5,275,862 | 1/1994 | Ramadan et al. | 428/537.1 X |
| 5,372,892 | 12/1994 | Keith | 428/537.1 |
| 5,386,964 | 2/1995 | Mayo | 248/346.01 |

*Primary Examiner*—Daniel P. Stodola
*Assistant Examiner*—Curtis Cohen
*Attorney, Agent, or Firm*—Paul H. Gallagher

[57] ABSTRACT

A mat for a desk or other type of furniture. It incorporates a plurality of layers glued together, including a bottom layer of cork, a middle layer made up of a single sheet of uniform plastic material, and a top layer. The top layer is any of wood, soft metal, and vinyl.

7 Claims, 1 Drawing Sheet

DESK TOP MAT

BACKGROUND OF THE INVENTION

The device of the invention is a mat to be placed on a desk, or other piece of furniture. The primary purpose of such a mat is to protect the desk surface, but the mat has another advantage, and very important purpose, namely to present an attractive enhancing appearance to the article of furniture.

The mat may be of a smaller size than the desk top, or it may be customized to be of the same size as the desk, if so desired, to present a complete surface that may appear as the actual desk surface itself.

SUMMARY OF THE INVENTION

A broad object of the invention is to provide a desk top mat of the foregoing general character, that is made up of a plurality of layers, coextensive in size and shape, that are thin and result in a thin dimension of the completed mat itself, and is aesthetically pleasing to the eye.

Another object is to provide a mat of the foregoing character, which includes a middle layer of great strength, that provides corresponding stability to the completed mat, and which functions to maintain the mat in flat condition, although the mat may be flexed by applying extra force for that purpose.

Another object is to provide a mat of the foregoing character having a middle layer of plastic material, and is adaptable to securement or adhering to other layers to provide a minimal thickness to the finished mat itself, forming a new combination.

An additional and specific object is to provide such a mat made up of materials that are reusable, and recyclable, and in long range may be considered degradable.

BRIEF DESCRIPTION OF THE INDIVIDUAL FIGURES OF THE DRAWINGS

Figure 7:
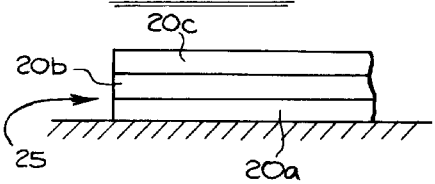

FIG. 7 indicates a return to flat condition after having been flexed.

Figure 3:
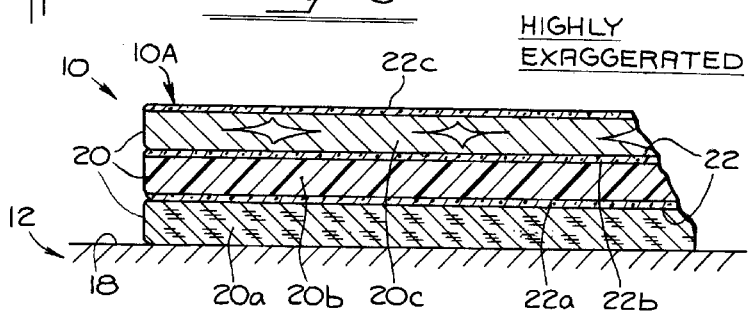
FIG. 3 is cross-sectional view of highly exaggerated dimensions of a mat made according to the invention, showing one form thereof.
Figure 8:
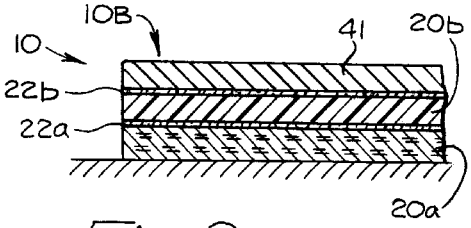

FIG. 8 is a view similar to FIG. 3, showing a second form.

Figure 9:
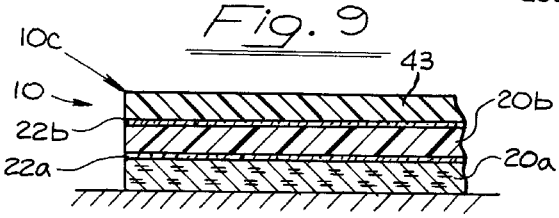

FIG. 9 is a view similar to FIGS. 3 and 8, showing a third form.

DETAILED DESCRIPTION

The following detailed description is directed first to the overall mechanical or physical construction of the mat, followed by details of the materials used therein, and the steps of making it.

The mat of the invention as disclosed herein indicated at 10, includes three different forms, shown in FIGS. 3, 8 and 9 respectively and are all designated generically at 10, and the individual ones are designated 10A, 10B, 10C. In this portion of the description, the first form 10A is described in detail, together with the apparatus for making it, and the end result, of the mat. Later, hereinbelow, the second and third forms, 10B, 10C are described individually in detail in their distinctions from the first form 10A.

Figure 1:
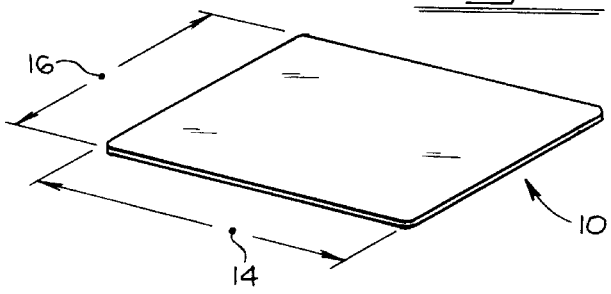
FIG. 1 is a perspective view of a desk top mat of the invention.
Figure 2:
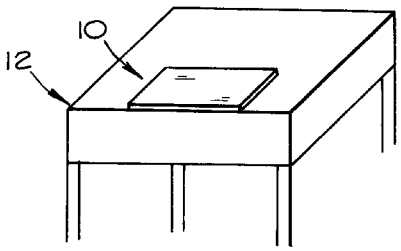
FIG. 2 is a perspective of a mat resting on a desk.

Referring to the mat generically, attention is directed to FIG. 1 where the mat is shown alone. It is shown resting on a desk 12 in FIG. 2. The mat in its overall size and proportions is in the form of a thin sheet, as indicated in FIG. 1, and it may be of any desired outline dimensions. For example, it may be dimensioned as in FIG. 2 where it occupies a small portion of the surface of the desk. The mat also is well adapted to customized fabrication, that is, it may be made of the same size and shape of the desk top itself, so as to completely cover the desk, and may be of such make up in visual characteristics as to appear as a constructional part of the desk itself, and its surface to appear as the surface of the desk.

A very common outline size of mat is 36" wide in the direction 14, and 24" deep in the direction 16. It may be of other sizes instead, if desired, and there is no limit from a practical standpoint as to the size and proportions of the mat. These dimensions are of separate consideration from the customized mat referred to above, which it is the same size as the desk.

The mat will have a thickness depending on the character and thickness of all the layers making up the mat, as will be referred to again hereinbelow.

FIG. 3 indicates a desk 12 having a top surface 18 on which the mat 10 rests. The mat, as shown in this figure, is made up of three layers 20, being individually identified 20*a*, 20*b*, 20*c*. The bottom layer, 20*a* is made up of cork which provides a non-abrasive, but high gripping effect, normally holding the mat in position, but enabling it to be manually moved, even against the high friction effect, and in being so moved, it does not scratch or otherwise impair the surface of the desk. The cork layer 20*a* in itself is of known kind, being made of cork particles adhered together in a known manner to form a sheet.

The top layer 20*c* is of wood (in this case, FIG. 3). This top layer is referred to as a layer in the generic identification of the three layers, but also is referred to here, particularly in the claims, as a veneer. It is made of any of various kinds of wood referred to below, and is of sheet form and has a top surface which is exposed or visible in the complete mat.

The middle layer 20*b* is made of plastic material. Such a plastic material, known as PVC (Poly Vinyl Chloride) is provided in single sheet, of unitary and integral form, and bonded to the other layers as referred to below. This plastic material, or PVC, possesses various physical characteristics, well adapting it to its incorporation in the desk mat. It is non-absorbent, it is water repellent, is not affected by changes in temperature or humidity. It can expand and shrink without any curling effect, being compatible with the other layers in this respect. It is not adversely affected by the moisture in the glue. The PVC plastic middle layer provides substantial body to the mat, and is of great strength. It maintains the mat as a whole in proper shape, i.e. flat, and it resists accidental misshaping. It is continuous or uniform in thickness dimension throughout its outline area. It is well adapted to formation in uniform thickness, as by extruding, and its uniformity and thickness is not adversely affected by outside influences in the extruding step. The flat condition of the mat is shown particularly at 25 in FIG. 7. The mat is washable with soap and water type cleanser, and is solvent resistant.

The plastic sheet, or middle layer, is preferably about 0.060" to 0.093" in thickness, this being an example, and the invention is not limited to that thickness. The thickness of the plastic material is selected according to the desired thickness of the entire mat, which includes selected thickness of the bottom and top layers, and thus the plastic material, and the other layers, may be generally, and together, of the desired dimensions.

Figure 4:
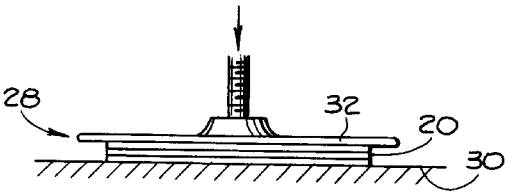
FIG. 4 is a view indicating high pressure applied in forming the mat.

In a specific example of a mat that was made according to the foregoing, the bottom layer of cork was 1/32" in thickness, the middle layer of plastic material of the thickness mentioned, namely about 1/16", and the top veneer layer of about 0.010" in thickness. The layers are adhered together by a glue which, as one example used, is a product called 3M—FAST BOND, also known as a green contact adhesive. This glue is a low volatile organic material, containing no CFC's—ozone depleting chemicals. It is re-usable, and may be recyclable, and is generally considered degradable in long range periods of time. The glue is applied to the three layers as mentioned, and then the stack of layers 20 is put in a press 28 as shown in FIG. 4, the press having a base 30 and a top plate 32. Suitable pressure is applied to this stack, such as 3000 lbs./sq. in., for in the neighborhood of 1–2 minutes. In this case also the value of the pressure and the time in which it is applied, are examples, and the invention is not limited specifically to those values.

This glue produces a high bonding effect with the plastic material of the middle layer, as well as the other layers. The moisture in the glue does not penetrate into the plastic material, nor does it affect the plastic as to shape. The plastic material is continuous, that is, it is uniform throughout its outline dimensions, in contrast to the bottom cork layer which is made up of separate particles distributed throughout its extent, but in close proximity to each other. The continuity of the middle layer would necessarily be uniform and thus different from that of the bottom layer.

The layers of glue are identified 22, individually as 22*a*, 22*b* in FIG. 3. The veneer, or top layer, 20*c* is coated with finish coating indicated 22*c*. This finish coating is of water-base character and is identified as Star Chemicals waterbase sealer and lacquer. This finish coating is environmentally friendly and from a practical standpoint may be considered biodegradable. Referring to the overall materials of the mat, the layers 20*a* and 20*c* are of wood product, and as indicated above are therefore biodegradable; the glue 22*a*, 22*b*, and the finish coating 22*c*, are completely environmentally friendly, and also from a practical standpoint may be considered degradable.

Figure 6:
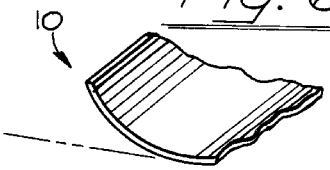
FIG. 6 is a fragmentary perspective view of a mat in a flexed or bent condition, indicating its flexibility.

The finish coating 22*c* has an added advantage in that when applied to the veneer 20*c*, it enables the mat, including the veneer and the other two layers, to be flexed, or bent, as indicated in FIG. 6. This may be done without fracture or other impairment to any of the materials of any of the layers. The finish coating is applied of course to the upper surface of the veneer, and in addition to enabling the flexing thereof, it protects the veneer whereby the veneer becomes resistant to outside materials, including for example, coffee, soft drinks, alcohol, etc.

The incorporation of the plastic sheet, as the middle layer, does not adversely affect the bottom and top layers. For example, any of a variety of woods may be selected for making up the top layer, or veneer, 20*c*, the selection being made for example for appearance sake, both for its own appearance, per se, or its blending or contrast with the appearance of the desk on which the mat is placed. Various woods serving the purpose may include for example oak, walnut, mahogany, cherry, maple, and teak. The appearance relationship with the desk may be determined by the relationship of FIG. 2, i.e. the mat is considerably smaller than the desk, and the appearance of the mat is utilized in blending with or contrasting with the appearance of the desk itself. In the case of a customized mat that covers the entire desk, there would be no contrast between the mat and the top surface of the desk, and the mat itself may be made of such selected material as to appear to be the top element or top surface of the desk.

While the first form of the mat, as described above, includes the feature that the top layer, or veneer, is made of wood, it may be composed of other materials instead, as disclosed in two additional forms of FIGS. 8 and 9. The second form, 10B, of FIG. 8 includes the same bottom and middle layer 20*a*, 20*b*, but the top layer or veneer, here designated 41, is made of soft metal. Such soft metals as are adaptable to the present construction include for example, aluminum, copper, and pewter but such metals as gold and silver may be considered, if such should be desired. Veneer of soft metal, is secured to the middle layer by the same glue as utilized in the first form, with full effect of totally binding the veneer throughout its extent with the middle layer.

The metal veneer utilized is preferably of a type having a phenolic backer applied to the shear metal. The backer may be of craft paper impregnated with phenolic material. The backer possesses textured structure, which imparts texture to the back side or under surface of the metal. This backer provides stability of the metal and increased adherence to the middle layer. The metal need not be covered with a finish coating in the fabrication of the mat, but it may or may not have a finish coating provided by the supplier.

The third form of mat, shown in FIG. 9, and designated 10C, is similar to the first two forms in that it includes the bottom layer of cork 20*a*, and the middle layer of plastic 20*b*, with the same kind of glue securing the layers together. In the present case, in the mat 10C, the top layer or veneer, designated 43, is made of high grade vinyl. This layer may vary in thickness but generally is of about the same as that of the top layer or veneer of the first two forms, and the same glue, in the layers 22*a*, 22*b*, provides full adhering effect for securing the top layer or veneer 43 to the middle layer. The veneer 43 of vinyl need not be provided with a finish coating, although it may be so coated if desired. The vinyl may have a smooth upper surface, or a textured such surface as desired. Preferably it is incorporated in the mat as provided by the supplier, this feature being an advantage in the economy of manufacture. In all the forms, the plastic of the middle layer may be the same. The several layers, in the different forms, constitute separate and effective combinations.

In the case of the first form, the features and advantages were set out fully hereinabove, most particularly, in the blending and contrast of the wood veneer with the wood of the desk. In the case of the second form, 10B, the metal veneer produces a very great and unusual visual effect, as well as providing all of the other advantages of the other forms. In the case of the third form, 10C, an unusual visual effect is produced, but it has an additional advantage in the ease of manufacture and corresponding economy thereof. Vinyl material can be handled very readily and quickly, and as compared with other materials in many cases is inexpensive.

Figure 5:
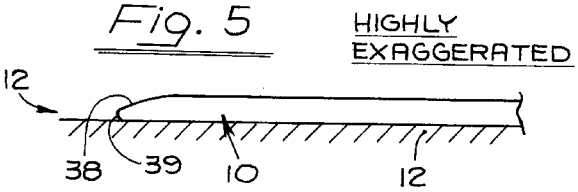
FIG. 5 is an edge view of a mat on a desk.

In each of the three forms, the edge of the mat may be curved or reduced as indicated at 38 in FIG. 5. This reduced dimension, or incline, may be very gradual for the most part, and have a relatively fine edge 39, the latter however being not so fine as to be sharp. This incline or taper increases the effect of the blending of the surfaces of the mat and the desk. Even in the case of a customized mat, in which the mat is of the same size and shape as the desk, the tapered edge 38 may be used also, to present a finished appearance blending into the edge of the desk.

In each of the three forms, decorations or designs may be impressed on the top layer, which may be pictures, or imitations of construction effects. The finish layer may be transparent for observing such decorations on the veneer, and of course that finish surface may be colored, or opaque, or have other unusual effects.

The mat in each case is relatively heavy in weight, although flexible. It has great durability and longevity, and maintains clean and solid edges, by the absence of curling and peeling of the edges. Additionally, there is no wearing, or appearance thereof, at the edges.

Within the scope of the invention, the mat may be made according to the foregoing, in which the mat is constituted entirely by the layers 20, and does not have a separate border, that is, the edges of the layers together constitute the corresponding edges of the entire mat. However, if it should be desired, the mat as disclosed hereinabove may be utilized together with a border member, or other features or accoutrements.

I claim:

1. A desk top mat comprising, the mat having a predetermined outline shape and size and being flexible, a bottom layer composed of soft and high friction non-abrasive material, a middle layer composed solely and uniformly of non-absorbent PVC material, and a top layer composed of a vaneer wood, each end and all of said layers being flat and sheet-like in form and being of said outline shape and size, the layers being stacked in face-to-face relation, and thereby together defining the outline shape and size of the mat, each layer being of uniform composition and of the same thickness throughout its extent, and thereby having opposite flat surfaces extended throughout its area, the layers being fitted together and secured together by glue throughout their extent, and the resulting mat itself thereby having opposite flat surfaces extending throughout its area, the three said layers constituting the entire structure of the mat throughout its extent, and the resulting mat thereby being of the same thickness throughout its extent, and of uniform composition in thickness direction at all locations throughout its extent, the mat being capable of lying flat on a supporting surface.

2. A desk top mat according to claim 1 wherein, the middle layer is of a thickness of in the range of 0.060" to 0.093", the bottom layer is of a thickness of about 1/32", and the top layer is of a thickness of 0.025"±.

3. A desk top mat according to claim 1 wherein, the top layer is a vaneer of any of oak,
walnut,
mahogany,
cherry,
apple,
teak.

4. A desk top mat comprising, a bottom layer composed of soft and high friction, non-abrasive material, a middle layer composed of non-absorbent material, and a top layer constituted by a veneer of soft metal and having a phenolic backer, said layers being secured together by glue, said layers, with the glue, constituting the complete mat, and the mat having an original flat shape and being flexible as a unit and returning to its original flat shape.

5. A desk top mat according to claim 4 wherein, the phenolic backer is of a textured structure.

6. A desk top mat According to claim 5 wherein, the metal itself is smooth and the phenolic backer is applied only to the back side of the metal, the backer is of textured structure and provides consequent stability of the structure to the metal.

7. A desk top mat comprising, a bottom layer composed of soft and high friction, non-abrasive material, a middle layer composed of non-absorbent material, and a top layer constituted by a veneer of soft metal which constitutes the sole material of the veneer, without a backer, said layers being secured together by glue, said layers, with the glue, constituting the complete mat, and the mat having an original flat shape and being flexible as a unit and returning to its original flat shape.

* * * * *